US006913389B2

(12) United States Patent
Kannankeril et al.

(10) Patent No.: US 6,913,389 B2
(45) Date of Patent: Jul. 5, 2005

(54) METALLIC LAMINATED GUSSETED INSULATED BAG

(75) Inventors: Charles Kannankeril, North Caldwell, NJ (US); Atul Arora, Piscataway, NJ (US); Dale Wormwood, Lebanon, NJ (US)

(73) Assignee: Sealed Air Corporation (US), Saddle Brook, NJ (US)

( * ) Notice: Subject to any disclaimer, the term of this patent is extended or adjusted under 35 U.S.C. 154(b) by 82 days.

(21) Appl. No.: 10/325,267

(22) Filed: Dec. 20, 2002

(65) Prior Publication Data

US 2004/0120611 A1 Jun. 24, 2004

(51) Int. Cl.[7] ..... B65D 33/16
(52) U.S. Cl. ..... 383/91; 383/110; 383/120
(58) Field of Search ..... 383/110, 120, 383/84–85, 91, 104

(56) References Cited

U.S. PATENT DOCUMENTS

| | | | | | |
|---|---|---|---|---|---|
| 1,236,159 | A | * | 8/1917 | Gatlin | 383/85 |
| 1,288,290 | A | | 12/1918 | Thrasher | |
| 1,482,783 | A | | 2/1924 | Boucher | |
| 1,719,347 | A | * | 7/1929 | Weinstein et al. | 383/85 |
| 1,802,276 | A | | 4/1931 | Schardt | |
| 1,899,892 | A | | 2/1933 | D'Este | |
| 2,197,490 | A | | 4/1940 | Williams | |
| 2,308,527 | A | | 1/1943 | Look | |
| 2,475,236 | A | | 7/1949 | Gollub | |
| 2,592,081 | A | | 4/1952 | Toulmin | |
| 3,327,926 | A | * | 6/1967 | Kreamer | 383/85 |
| 3,811,613 | A | | 5/1974 | Harrison | |
| 3,955,749 | A | * | 5/1976 | Turkenkopf | 383/122 |
| 4,394,955 | A | * | 7/1983 | Raines et al. | 383/86 |
| 4,580,683 | A | | 4/1986 | Gochenour | |
| 5,041,264 | A | | 8/1991 | Williams | |
| 5,150,971 | A | | 9/1992 | Strong et al. | |
| 5,639,523 | A | * | 6/1997 | Ellis | 428/34.2 |
| 5,820,268 | A | | 10/1998 | Becker et al. | |
| 6,007,467 | A | | 12/1999 | Becker et al. | |
| 6,080,096 | A | | 6/2000 | Becker et al. | |
| 6,139,188 | A | | 10/2000 | Marzano | |
| 6,182,395 | B1 | | 2/2001 | Weder et al. | |
| 6,450,685 | B1 | * | 9/2002 | Scott | 383/63 |

FOREIGN PATENT DOCUMENTS

| | | |
|---|---|---|
| GB | 2 316 699 A | 3/1998 |

* cited by examiner

*Primary Examiner*—Jes F. Pascua
(74) *Attorney, Agent, or Firm*—Mark B. Quatt

(57) ABSTRACT

A metallic laminated gusseted insulated bag includes a front and rear wall each having two lateral edges, a top edge, and a bottom edge; first and second side walls; a bottom member; and a means for hermetically closing the bag; wherein the front and rear walls are joined along their respective lateral edges to the first and second side walls; either or both of the side walls and bottom member are gusseted; and the front and rear walls are joined along their respective bottom edges to the bottom member; and the front and rear walls each include an outer ply including a metallic foil or metallic coated web, and an inner ply having an inner and outer surface, including a thermal insulating layer; the metallic foil or metallic coated web being adhered to the outer surface of the inner ply.

9 Claims, 7 Drawing Sheets

METALLIC LAMINATED GUSSETED INSULATED BAG

FIELD OF THE INVENTION

The present invention relates to a bag, more particularly to a metallic laminated gusseted insulated bag.

BACKGROUND OF THE INVENTION

It is known to use laminated insulation materials to construct bags which can provide physical cushioning of the contents of the bag, as well as thermal insulation properties. These bags are generally made by folding the laminated composite to produce the bag.

Unfortunately, these bags are generally deficient in two respects.

First, these bags typically do not provide a flat bottom for placing large or flat bottom objects such as frozen fish, ice cream, pharmaceutical containers, and beverages.

Secondly, these bags typically do not provide a means for providing a hermetic closure. An airtight closure system would significantly improve the thermal insulation properties of such bags.

SUMMARY OF THE INVENTION

In a first aspect, a metallic laminated gusseted insulated bag comprises a front wall having two lateral edges, a top edge, and a bottom edge; a rear wall having two lateral edges, a top edge, and a bottom edge; a first gusseted side wall having two lateral edges, a top edge, and a bottom edge; a second gusseted side wall having two lateral edges, a top edge, and a bottom edge; a bottom member; and a means for hermetically closing the bag; wherein the front and rear walls are joined along their respective lateral edges to the respective lateral edges of the first and second gusseted side walls; the front and rear walls are joined along their respective bottom edges to the bottom member; and the first and second gusseted side walls are joined along their respective bottom edges to the bottom member; the front and rear walls, and the first and second gusseted side walls, each comprising an outer ply comprising a metallic foil or metallic coated web, and an inner ply having a first surface and a second surface, the inner ply comprising a thermal insulating layer; the metallic foil or metallic coated web being adhered to the first surface of the inner ply.

In a second aspect, a method of making a metallic laminated gusseted insulated bag comprises providing a metallic foil or metallic coated web; providing a thermal insulating layer; laminating the metallic foil or metallic coated web to the thermal insulating layer to form a metallic insulating laminate; cutting the laminate to form a blank; and folding and adhering portions of the blank to produce a bag comprising a front wall having two lateral edges, a top edge, and a bottom edge; a rear wall having two lateral edges, a top edge, and a bottom edge; a first gusseted side wall having two lateral edges, a top edge, and a bottom edge; a second gusseted side wall having two lateral edges, a top edge, and a bottom edge; a bottom member; and a means for hermetically closing the bag; wherein the front and rear walls are joined along their respective lateral edges to the respective lateral edges of the first and second gusseted side walls; the front and rear walls are joined along their respective bottom edges to the bottom member; and the first and second gusseted side wall are joined along their respective bottom edges to the bottom member; and wherein the means for hermetically closing the bag comprises a closure flap, attached to the top edge of the rear wall, the closure flap having a first and second lateral flap extension, the flap adapted to fold down over the top edges of the front and rear wall, and the first and second lateral flap extensions adapted to fold inwardly across a portion of the back wall of the bag, after the flap has been folded down.

In a third aspect, a method of making a metallic laminated gusseted insulated bag comprises providing a metallic foil or metallic coated web; providing a thermal insulating layer; laminating the metallic foil or metallic coated web to the thermal insulating layer to form a metallic insulating laminate; cutting the laminate to form a blank; and folding and adhering portions of the blank to produce a bag comprising a front wall having two lateral edges, a top edge, and a bottom edge; a rear wall having two lateral edges, a top edge, and a bottom edge; a first gusseted side wall having two lateral edges, a top edge, and a bottom edge; a second gusseted side wall having two lateral edges, a top edge, and a bottom edge; a bottom member; and a means for hermetically closing the bag; wherein the front and rear walls are joined along their respective lateral edges to the respective lateral edges of the first and second gusseted side walls; the front and rear walls are joined along their respective bottom edges to the bottom member; and the first and second gusseted side wall are joined along their respective bottom edges to the bottom member; and wherein the means for hermetically closing the bag comprises a closure flap attached to the top edge of the rear wall, and a supplemental flap, having a top and bottom edge, the supplemental flap attached at its bottom edge to a portion of the front wall of the bag; the closure flap and supplemental flap adapted to adhere together, when the bag is closed, to form a hermetic seal.

In a fourth aspect, a metallic laminated gusseted insulated bag comprising a front wall having two lateral edges, a top edge, and a bottom edge; a rear wall having two lateral edges, a top edge, and a bottom edge; a gusseted bottom member; and a means for hermetically closing the bag; wherein the front and rear walls are joined along their respective lateral edges; and the front and rear walls, and the gusseted bottom member, each comprise an outer ply comprising a metallic foil or metallic coated web, and an inner ply having an inner surface and an outer surface, the inner ply comprising a thermal insulating layer; the metallic foil or metallic coated web being adhered to the outer surface of the inner ply.

In a fifth aspect, a method of making a metallic laminated gusseted insulated bag comprises providing a metallic foil or metallic coated web; providing a thermal insulating layer; laminating the metallic foil or metallic coated web to the thermal insulating layer to form a metallic insulating laminate; longitudinally folding the laminate to create a centerfolded laminate; forming a gusset in the centerfolded laminate; making a first and second transverse seal in the gusseted, centerfolded laminate; and making a first and second transverse cut in the gusseted, centerfolded laminate to produce a bag comprising a front wall having two lateral edges, a top edge, and a bottom edge; a rear wall having two lateral edges, a top edge, and a bottom edge; a gusseted bottom member; and a means for hermetically closing the bag; wherein the front and rear walls are joined along their respective lateral edges; and the front and rear walls, and the gusseted bottom member, each comprise an outer ply comprising a metallic foil or metallic coated web, and an inner ply having an inner surface and an outer surface, the inner ply comprising a thermal insulating layer; the metallic foil or metallic coated web being adhered to the outer surface of the inner ply.

BRIEF DESCRIPTION OF THE DRAWINGS

A detailed description of preferred embodiments of the invention follows, with reference to the attached drawings, wherein.

DEFINITIONS

Figure 1:
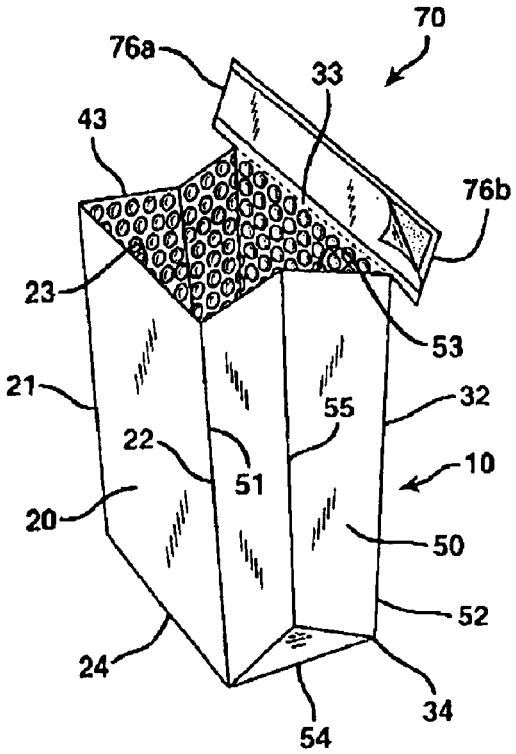
FIG. 1 is a perspective view of a metallic laminated gusseted insulated bag in accordance with the present invention, with a means for hermetically closing the bag, the bag viewed in a stand-up and open condition.

"Thermal insulating layer" refers to a layer of the bag of the invention, which layer comprises, in whole or in part, a material that provides some level of thermal insulation. Such thermal insulating material includes without limitation air cellular material, foamed material, cellulosic material, and/or synthetic fibers.

"Air cellular material" herein refers to bubble cushioning material, such as BUBBLE WRAP® air cushioning material sold by Sealed Air Corporation, where one film or laminate is thermoformed, embossed, calendared, or otherwise processed to define a plurality of cavities, and another film is adhered to the "open" side of the thermoformed or otherwise processed film or laminate in order to close the cavities. Air cellular material typically utilizes two films which are laminated together. Usually, only one of the films is embossed, i.e., thermoformed in a manner to provide a plurality of protrusions when viewed from one side of the film, the protrusions being cavities when viewed from the other side of the film. Generally, these protrusions are regularly spaced and have a cylindrical shape, with a round base and a domed top. The formed film is generally laminated to a flat film in order to form the air cellular product. In another version, two formed films are laminated to one another to form the cellular product. Conventional methods of making such material involves the use of a vacuum source to deform polymer film to form bubbles or pockets that can be filled with air (or other gases) to form bubbles. Such materials can be made using a heated drum having recesses that are connected to a vacuum source. When vacuum is applied, each of various regions of the heated film in contact with the drum is drawn into respective recesses on the drum. The heated film is deformed and thinned in the regions drawn into the recess by the vacuum process. One portion of the resulting film remains "flat", while another portion is not flat, but rather is "thermoformed". A second film, which preferably is a flat film, i.e., not thermoformed, is fused to the flat portion of the formed film, resulting in a plurality of sealed, air-filled "bubbles." Alternatives such as laminating two films together, and then inflating the interior of the two sheets to form a plurality of inflated cells, is also within the scope of "air cellular material" as used herein. Other alternatives within this definition are shown in U.S. Pat. No. 3,660,189 (Troy), U.S. Pat. Nos. 4,576,669 and 4,579,516 (Caputo), U.S. Pat. No. 4,415,398 (Ottaviano), U.S. Pat. Nos. 3,142,599, 3,508,992, 3,208,898, 3,285,793, and 3,616,155 (Chavannes), U.S. Pat. No. 3,586,565 (Fielding), U.S. Pat. No. 4,181,548 (Weingarten), and U.S. Pat. No. 4,184,904 (Gaffney), all of which are incorporated herein by reference in their entirety. It is known to prepare laminated inflatable articles which can be shipped to a converter uninflated, and inflated immediately before use. Such inflatable articles are typically made from two heat sealable films which are fused together in discrete areas to form one or more inflatable chambers. Alternatively, conventional air cellular material fabricating processes can include a first stage film fabrication step and a separate second stage fusing step. In the first stage, polymer films are fabricated by conventional techniques known to those in the art of polymer film fabrication. In the second stage, the polymer films are combined according to heat sealing methods that are known to those in the art of polymer film sealing techniques. In yet another alternative, plastic webs constitute a plurality of transparent thermoplastic laminae joined face to face and formed so that the laminae mutually define a multiplicity of pockets which are filled with gas. "Air cellular material" herein specifically excludes foamed materials. Air cellular material can be made from any suitable polymeric material, including without limitation ethylene homopolymer or copolymer, including ethylene/alpha-olefin copolymer, ethylene/vinyl acetate copolymer, and ethylene/alkyl acrylate copolymer; amide polymer and copolymer; polyester and copolyester; and propylene polymer or copolymer;

As an alternative to air cellular materials, the present invention contemplates the use of foamed materials, such as polyolefin foams, particularly polyethylene foams. Methods for manufacturing such foams are well known in the art, as disclosed in e.g., U.S. Pat. No. 5,348,984 (Lee), U.S. Pat. No. 5,462,974 (Lee), and U.S. Pat. No. 5,667,728 (Lee), all of which are incorporated herein by reference in their entirety. One of the most common polyethylenes used is low density polyethylene (LDPE). Preferably, foams in accordance with the present invention have a density ranging from about 0.5 to about 15 pounds/ft$^3$. The foam may be in the form of a sheet or plank having a thickness ranging from about 0.015 to about 5 inches. In producing the foam sheets, any conventional chemical or physical blowing agents may be used. Preferably, the blowing agent is a physical blowing agent such as carbon dioxide, ethane, propane, n-butane, isobutane, pentane, hexane, butadiene, acetone, methylene chloride, any of the chlorofluorocarbons, hydrochlorofluorocarbons, or hydrofluorocarbons, as well as mixtures of the foregoing. If desired or necessary, various additives may also be included with the polymer. For example, it may be desirable to include a nucleating agent (e.g., zinc oxide, zirconium oxide, silica, talc, etc.) and/or an aging modifier (e.g., a fatty acid ester, a fatty acid amide, a hydroxyl amide, etc.). Other additives that may be included if desired are pigments, colorants, fillers, antioxidants, flame retardants, stabilizers, fragrances, odor masking agents, and the like. Foam is preferably made by an extrusion process that is well known in the art. In such a process, the polymer, e.g., LDPE, is added to an extruder, preferably in the form of resin pellets. Any conventional type of extruder may be used, e.g., single screw, double screw, and/or tandem extruders. In the extruder, the resin pellets are melted and mixed. A blowing agent is preferably added to the melted polymer via one or more injection ports in the extruder. Any additives that are used may be added to the melted polymer in the extruder and/or may be added with the resin pellets. The extruder pushes the entire melt mixture (melted polymer, blowing agent, and any additives) through a die at the end of the extruder and into a region of reduced temperature and pressure (relative to the temperature and pressure within the extruder). Typically, the region of reduced temperature and pressure is the ambient atmosphere. The sudden reduction in pressure causes the blowing agent to nucleate and expand into a plurality of cells that solidify upon cooling of the polymer mass (due to the reduction in temperature), thereby trapping the blowing agent within the cells. Foamed material can be adhered to the multilayer film web of the invention by any suitable process, including heat lamination, the use of adhesive, or the like. Preferred foamed material has at least 70% closed cells, as a percent of the overall cells of the material. More preferred are at least 80%, such as at least 90% closed cells.

Another alternative for the thermal insulating material is cellulosic material, such as paper and paper fiber, including recycled paper, macerated paper, shredded paper, air entrapped cellulosic fibers, and tissues.

Synthetic fibers, such as those derived from virgin or recycled thermoplastic materials, and any other materials can also be used with benefit in the present invention to the extent that they provide some level of thermal insulation when the bag is hermetically closed.

"Bottom member" herein refers:

1) with respect to side gusseted bags, to a discrete element present at the bottom of the bag (e.g. a flap or section of material having an outer ply comprising a metallic foil or metallic coated web, and an inner ply having an inner surface and an outer surface, the inner ply comprising a thermal insulating layer, where the flap or section is adhered by suitable means, such as heat sealing, gluing, etc. to the lower portions of the front wall, rear wall, first and second gusseted side walls), or alternatively simply a member created by the lower portions of the front wall, rear wall, first and second gusseted side walls. e.g. in the form of a bottom fold and/or seal;
2) with respect to a bottom gusseted bag, to a bottom seal and the inside fold or tuck created by the lower portions of the front and rear walls when the bottom is gusseted.

"Polymer" herein refers to homopolymer, copolymer, terpolymer, etc. "Copolymer" herein includes copolymer, terpolymer, etc.

All compositional percentages used herein are presented on a "by weight" basis, unless designated otherwise.

DETAILED DESCRIPTION OF THE INVENTION

Figure 2:
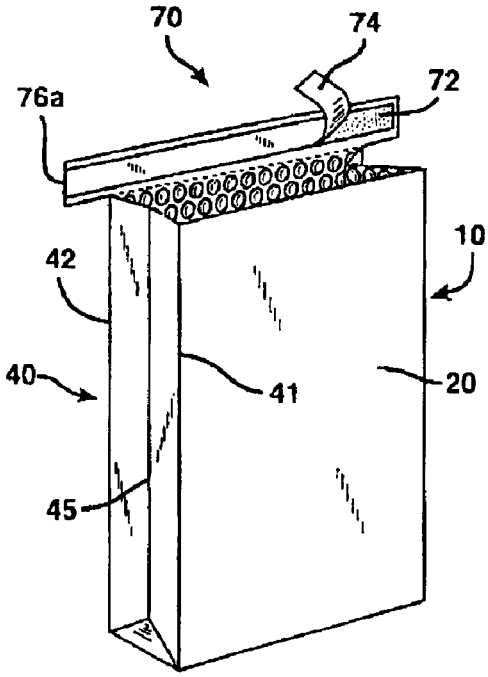
FIG. 2 is a different perspective view of the bag of FIG. 1, and a closure flap with a release tape partially pulled away from the flap to disclose the underlying adhesive layer.
Figure 3:
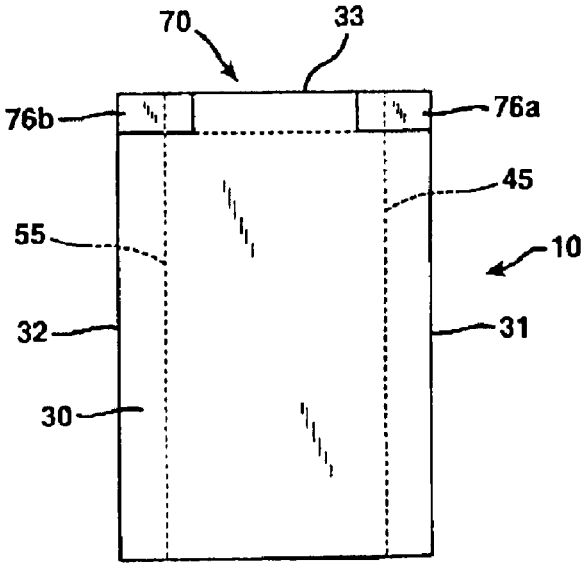
FIG. 3 is a rear elevational view of the bag of FIG. 1, with the closure flap in a folded over and closed position, and the lateral flap extensions partially folded over towards the rear wall of the bag.

FIGS. 1 and 2 disclose different perspective views of a bag of the invention, and including a closure flap in an open position (FIG. 1) and with a release tape partially pulled away from the flap to disclose the underlying adhesive layer (FIG. 2). FIG. 3 shows a rear view of the same bag, with the closure flap in a folded over and closed position, and the lateral flap extensions partially folded over towards the rear wall of the bag.

Figure 9:
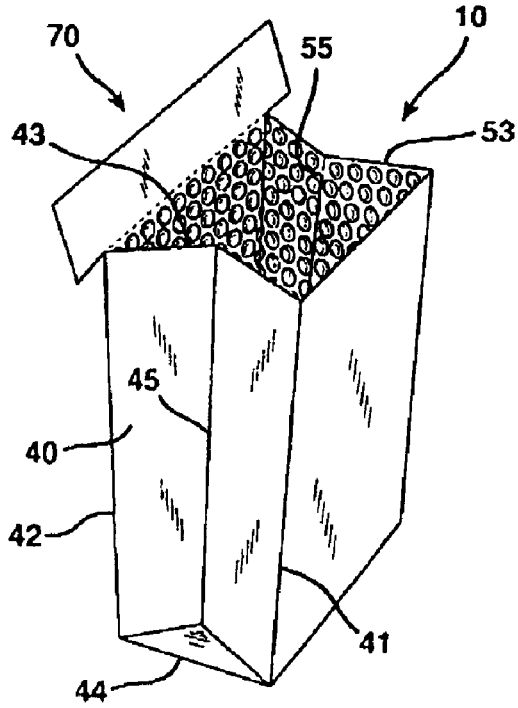
FIG. 9 is another perspective view of the bag of FIG. 1.

The bag 10 includes a front wall 20 having two lateral edges 21 and 22, a top edge 23, and a bottom edge 24; a rear wall 30 (best seen in FIG. 3) having two lateral edges 31 and 32, a top edge 33, and a bottom edge 34; a first gusseted side wall 40 (see FIGS. 2 and 9) having two lateral edges 41 and 42, a top edge 43, a bottom edge 44, and a gusset fold line 45; a second gusseted side wall 50 having two lateral edges 51 and 52, a top edge 53, a bottom edge 54, and a gusset fold line 55; a planar bottom member 60; and a closure flap 70.

The closure flap 70 can be formed either integrally as an extension of rear wall 30, or as a discrete member that is separately made and then adhered, e.g. by a suitable adhesive, heat sealing, radio frequency sealing, ultrasonic sealing, etc., to the upper portion of rear wall 30.

The closure flap 70 includes an adhesive layer 72, adhered directly or indirectly to the interior surface of the closure flap 70 (for one embodiment, this will be the interior surface of the extended portion of rear wall 30), as well as an optional but highly desirable release tape 74.

The closure flap is wider than the front wall 20 or rear wall 30, and thus includes a first and second lateral flap extension **76*a* and 76*b* respectively at each end of flap 70**.

When the bag is to be used to store or hold an article such as frozen fish, ice cream, pharmaceutical containers, or beverages, the article is placed in the interior of the bag, and the release tape 74 is peeled from the closure flap 70. This action exposes adhesive layer 72 (see FIG. 2). The closure flap 70, with the adhesive layer 72 thus exposed, is then folded forward towards the front wall 20 of the bag, and the closure flap 70 is then pressed against the front wall 20 to seal the bag. The first and second lateral flap extensions **76*a* and 76*b* are then folded around the lateral edges of the front wall 20, and pressed against and adhered to a portion of rear wall 30**.

Thus, in FIG. 3, the closure flap is shown as pressed against the upper portion of the front wall 20 of the bag to close the bag, and the lateral flap extensions 76*a* and 76*b* are shown being folded around the edges of the front wall 20, and towards the rear wall 30.

The result is a bag that is insulated, and hermetically sealed. "Hermetic" is used herein in its usual sense of being airtight, but also includes a bag that, when closed, limits ingress of air enough to provide some thermal insulative properties.

The adhesive used in adhesive layer 72 is preferably a pressure sensitive adhesive, but can be any suitable adhesive, such as an adhesive activated by moisture or saliva. Suitable adhesives include thermoplastic hot melt adhesives, silicone adhesives, acrylic pressure sensitive adhesives, solvent cast adhesives, UV (ultraviolet) or EB (electron beam) cured acrylic adhesives, and the like.

Those skilled in the art will understand and be familiar with the manufacture and application of release tapes on adhesive layers or substrates, and the wide variety of commercially available adhesives for this type of application.

Figure 4:
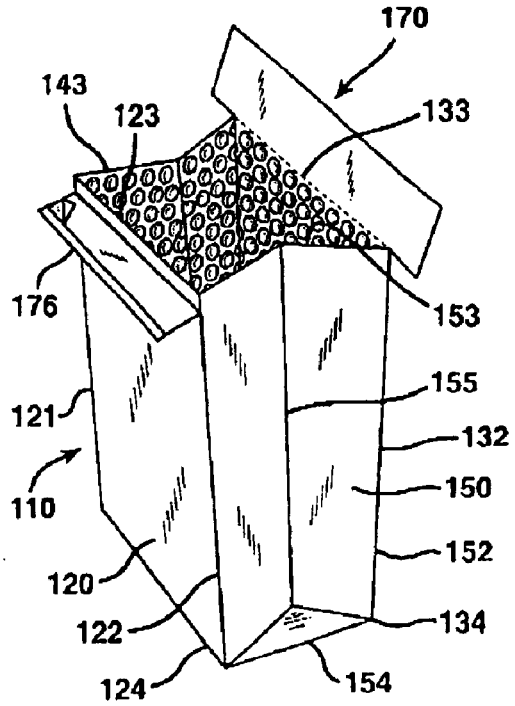
FIG. 4 is a perspective view of an alternative embodiment of a metallic laminated gusseted insulated bag in accordance with the present invention, with a means for hermetically closing the bag, the bag viewed in a stand-up and open condition.
Figure 5:
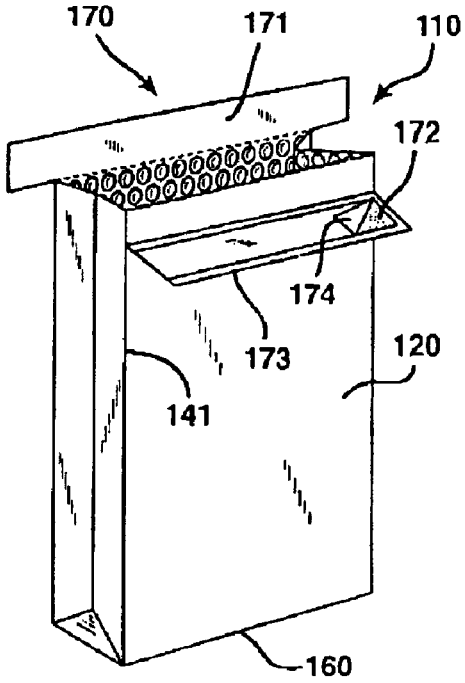
FIG. 5 is a different perspective view of the bag of FIG. 4, with the bottom portion folded over to show its relationship to the remainder of the bag, and a closure flap with a release tape partially pulled away from the flap to disclose the underlying adhesive layer.
Figure 6:
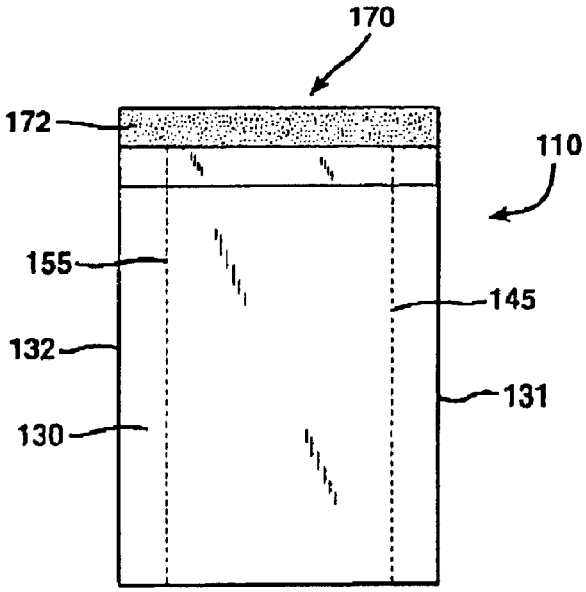
FIG. 6 is a rear elevational view of the bag of FIG. 4, with the closure flap in a closed position.

FIGS. 4 and 5 disclose different perspective views of an alternative embodiment of a bag of the invention, and including a two part closure flap in an open position (FIG. 4) and with a release tape partially pulled away from one part of the flap to disclose the underlying adhesive layer (FIG. 5). FIG. 6 shows a rear view of the same bag, with the closure flap in a closed position.

The bag 110 includes a front wall 120 having two lateral edges 121 and 122, a top edge 123, and a bottom edge 124; a rear wall 130 (best seen in FIG. 6) having two lateral edges 131 and 132, a top edge 133, and a bottom edge 134; a first gusseted side wall 140 (see FIG. 10) having two lateral edges 141 and 142, a top edge 143, a bottom edge 144, and a gusset fold line 145; a second gusseted side wall 150 having two lateral edges 151 and 152, a top edge 153, a bottom edge 154, and a gusset fold line 155; a planar bottom member 160; a closure flap 170, and a supplemental flap 176.

The first part 171 of closure flap 170 can be formed either integrally as an extension of rear wall 130, or as a discrete member that is separately made and then adhered, e.g. by a suitable adhesive, heat sealing, radio frequency sealing, ultrasonic sealing, etc., to the upper portion of rear wall 130.

The second part 173 of closure flap 170 includes an adhesive layer 172, adhered directly or indirectly to the interior surface of the second part 173 of closure flap 170, as well as an optional but highly desirable release tape 174.

An alternative embodiment includes the application of the adhesive layer to one side of the first part 171 of closure flap 170, with or without a release tape covering the adhesive. Alternatively, both the first part 171 and second part 173 can include the adhesive layer and optionally a release tape.

When the bag is to be used to store or hold an article such as frozen fish, ice cream, pharmaceutical containers, or beverages, the article is placed in the interior of the bag, and the release tape 174 is peeled from the second part 173 of closure flap 170. This action exposes adhesive layer 172 (see FIG. 5). The second part 173 of closure flap 170, with the adhesive layer 172 thus exposed, is then folded up towards, and pressed against the nearest side of first part 171 of closure flap 170 to seal the bag.

Thus, in FIG. 6, the first part 171 and second part 173 of closure flap 170 are shown as pressed together to close the bag.

The result is a bag that is insulated, and hermetically sealed. "Hermetic" is used herein in its usual sense of being airtight, but also includes a bag that, when closed, limits ingress of air enough to provide some thermal insulative properties.

The adhesive used in adhesive layer 172 can be of the type disclosed herein for adhesive layer 72.

Figure 7:
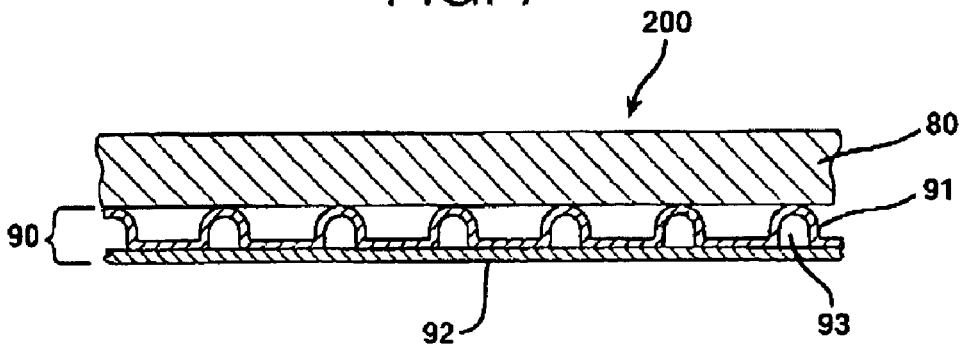
FIG. 7 is a schematic cross-sectional view of a metallic insulating laminate useful as a front or rear wall, first or second gusseted side wall, or bottom member of the bag.

FIG. 7 is a schematic cross-sectional view of a metallic insulating laminate 200 useful as a front and rear wall, first and second gusseted side wall, bottom member, and closure flap of the bag. The laminate 200 comprises an outer ply 80 and an inner ply 90.

The outer ply 80 comprises a metallic foil or metallic web. The foil is made solely from metal, such as aluminum. The metallic web can be a substrate, such as plastic or paper, to which a metal is applied as a distinct layer, e.g. as a thin foil, a sputter coating, or the like.

The inner ply 90 has an inner and outer surface, and comprises a thermal insulating material. Preferred is an air cellular or foamed material. The air cellular material can be e.g. a material such as BUBBLE WRAP™ air cellular material sold by Sealed Air Corporation. The air cellular material will typically comprise a formed layer 91 (the "bubbles" of the air cellular material), and a substrate layer 92 which closes the formed layer to define cavities 93 within the air cellular material. Layers 91 and 92 can be made of any suitable material, especially thermoplastics, and especially olefinic polymers such as ethylene polymer or copolymer. One or both of layers 91 and 92 can optionally have a multilayer construction, including e.g. an oxygen barrier material such as polyamide, polyester, polyvinylidene dichloride, or ethylene/vinyl alcohol copolymer.

The inner surface of the outer ply 80 is adhered by any suitable means, such as heat sealing, adhesives, etc., to the outer surface of the inner ply 90 (i.e. the outer surface of formed layer 91).

Alternatives will be apparent to those skilled in the art after a review of this disclosure. For example, the inner ply 90 can be arranged so that substrate layer 92 is in adhering contact with outer ply 80. This may be less desirable in that a smooth surface is not presented to the interior space formed by the bag, for product loading and emptying.

Although the outer ply 80, and inner ply 90, are preferably adhered to one another, in a less preferred embodiment, these plies can be simply juxtaposed at any suitable point in the manufacturing process. This is also less desirable in that the inner ply 90 of thermal insulating material could more easily be accidentally removed from the bag during loading and especially emptying of the contents of the bag.

Figure 8:
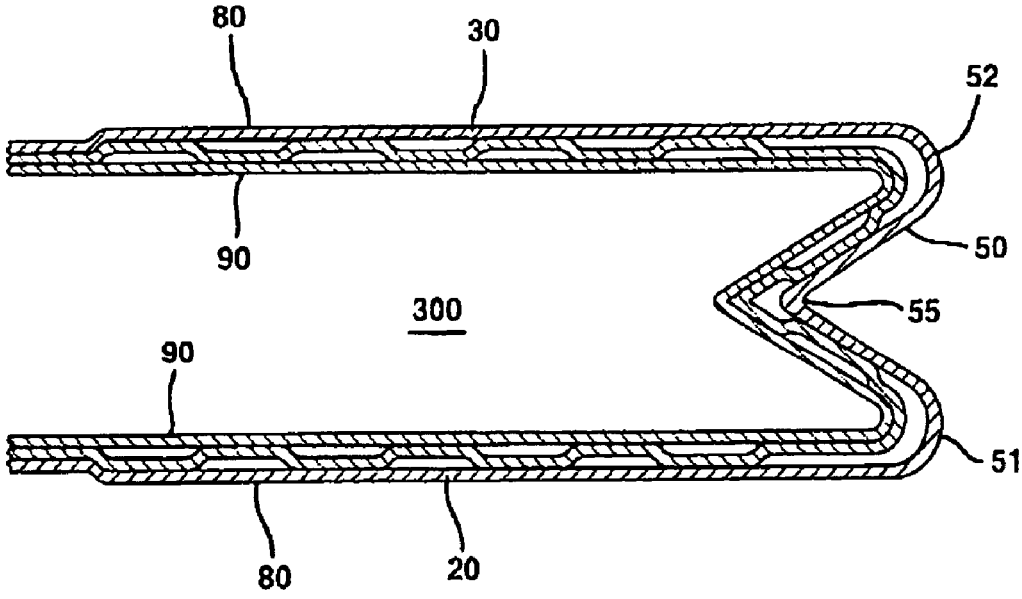
FIG. 8 is a cross sectional view of a cut away portion of a metallic laminated gusseted insulated bag in accordance with the present invention, made from the laminate of FIG. 7.

FIG. 8 is a partial cross-sectional cut-away view of the bag of FIG. 1. It discloses the front wall 20 constructed from metallic insulating laminate 200, comprising the outer ply 80 which faces the exterior of the bag, and an inner ply 90 which faces the interior 300 of the bag. The first gusseted side wall 50 is shown, with first and second lateral edges 51 and 52 (see also FIGS. 2 and 9), and the gusset fold line 55.

Figure 10:
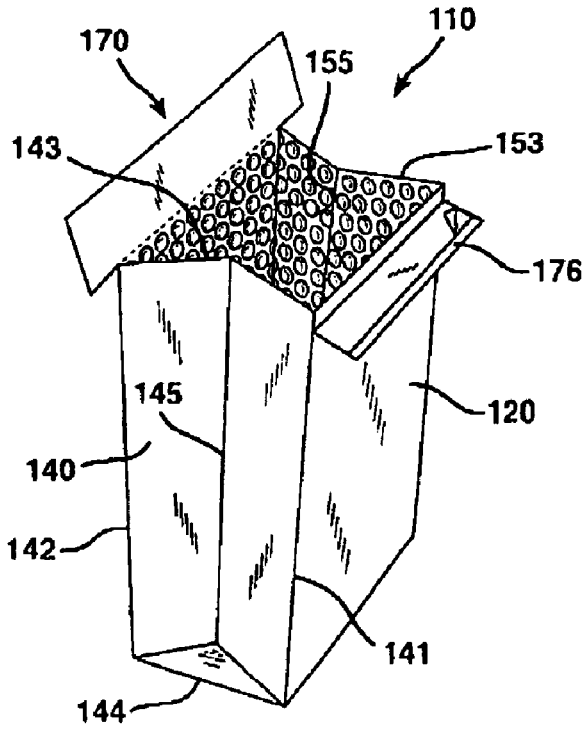
FIG. 10 is another perspective view of the bag of FIG. 4.

In an alternative embodiment, a bag according to the invention can be made like that disclosed in FIG. 10, but without the need for supplemental flap 176. In this embodiment, the closure flap 170 can include on one side thereof a suitable adhesive, and then folded over to contact the front wall 120 of the bag. A hermetic or nearly hermetic package can be thus produced.

An optional feature on bags in accordance with the present invention is the use of an easy-open feature in the bag. An example is a tear strip with a thread disposed in the closure flap of the bag.

Although the invention is described herein with respect to a bag that includes a closure flap, such as closure flap 70 or 170, those skilled in the art will understand that a hermetic seal can alternatively be achieved by sealing together the interior surfaces of the front and rear wall, e.g. walls 20 and 30, by simply bringing these two surfaces together by means of a heat seal, a pressure sensitive adhesive, or the like. In this embodiment, the front and rear walls are preferably of the same length, so as to provide a top edge of the front and rear walls that are coextensive.

The bag of the invention can be made by a number of different methods. One such method is shown in FIGS. 11 to 13.

Figure 11:
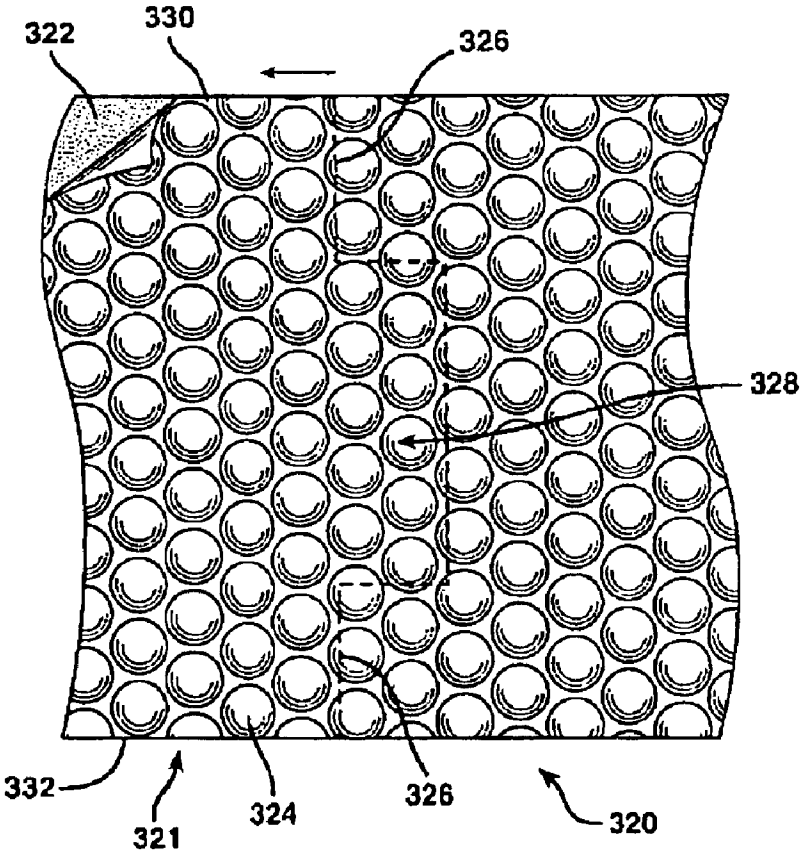
FIG. 11 is a planar view of a metallic insulating laminate in accordance with the present invention.

FIG. 11 is a planar view of a metallic insulating laminate 320 in accordance with the present invention. A metal foil or metallized foil 322 is adhered by any conventional means, such as an appropriate adhesive, to a thermal insulating material 324 such as BUBBLE WRAP® air cushioning material sold by Sealed Air Corporation. A perforated pattern 326 is made in the laminate in periodic fashion, one such pattern being shown in FIG. 11. The laminate 320 can be periodically pulled in the direction of the arrow to separate a section 321 of the laminate from the remainder of the laminate, along the perforations of perforated pattern 326. Alternatively, the laminate can simply be die cut, or otherwise cut or separated from the remainder of the laminate stock.

Figure 12:
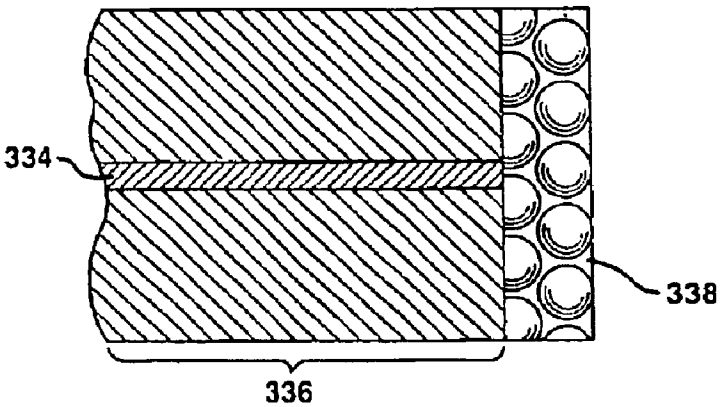
FIG. 12 is a planar view of the metallic insulating laminate of FIG. 11 after it has been cut, folded and longitudinally sealed.

FIG. 12 is a planar view of the section 321 of the metallic insulating laminate of FIG. 11 after it has been cut, pulled, or otherwise separated from the remainder of the laminate stock 320. The perforated pattern 326 defines an extended section 328 (see FIG. 11). Longitudinal edges 330 and 332 of the portion of the laminate are folded a desired distance toward each other (i.e. toward the longitudinal centerline of the laminate), and longitudinally sealed by heat sealing, adhesive, gluing, etc. in a fin or lap seal arrangement to produce a longitudinal seal 334. In the particular embodiment shown in FIG. 12, an unfolded section 338 of the laminate, corresponding to the trailing portion 328 of FIG. 11, extends from the folded section 336.

Figure 13:
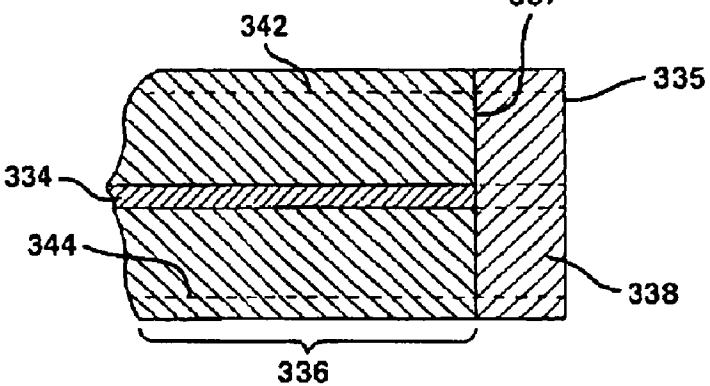
FIG. 13 is a planar view of the metallic insulating laminate of FIG. 12 after it has been gusseted along its sides, and the bottom member has been folded over and sealed to a wall of the bag.

FIG. 13 is a planar view of the portion 321 of metallic insulating laminate of FIG. 12 after it has been gusseted along its sides, and the unfolded section 338 has been folded over and sealed to a wall of the bag. Fold line 335 indicates the line along which the unfolded section 338 has been folded over to close the bottom of the final bag and form a bottom member of the bag to be made from the laminate. A transverse seal, made by heat sealing, adhesive, glue, or other appropriate closure mechanism, is indicated at 337. Side wall gussets are indicated at 342 and 344. Side wall gussets can be produced by any conventional method, including the use of a wheel on each side of the laminate that tucks in—the laminate on each side in chevron fashion. The result can be seen e.g. in the perspective views of FIGS. 14 and 15. The production of gussets, as well as the other operations described herein, can be performed manually or with appropriate equipment. Those skilled in the art will understand that, depending on the extent to which the longitudinal edges 330 and 332 of the portion 321 of the laminate are folded toward each other (see FIGS. 11 and 12), and depending on the geometry of extended section 328, some trimming or cutting of the edges of the interface of folded section 336 and unfolded section 338 may be necessary to accommodate the subsequent gusseting step shown in FIG. 13, and to accommodate the folding over of unfolded section 338.

Figure 17:
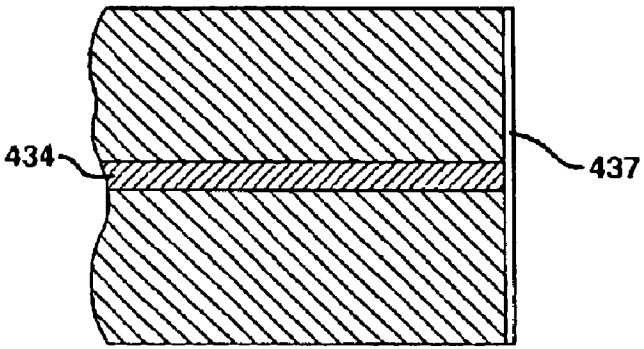
FIG. 17 is a planar view of the metallic insulating laminate of FIG. 16 after it has been cut, folded and longitudinally sealed.
Figure 18:
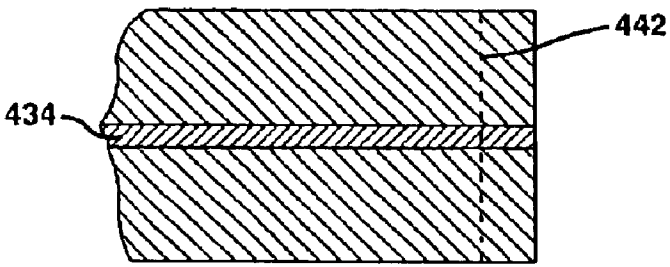
FIG. 18 is a planar view of the metallic insulating laminate of FIG. 17 after it has been sealed and gusseted along its bottom member.
Figure 16:
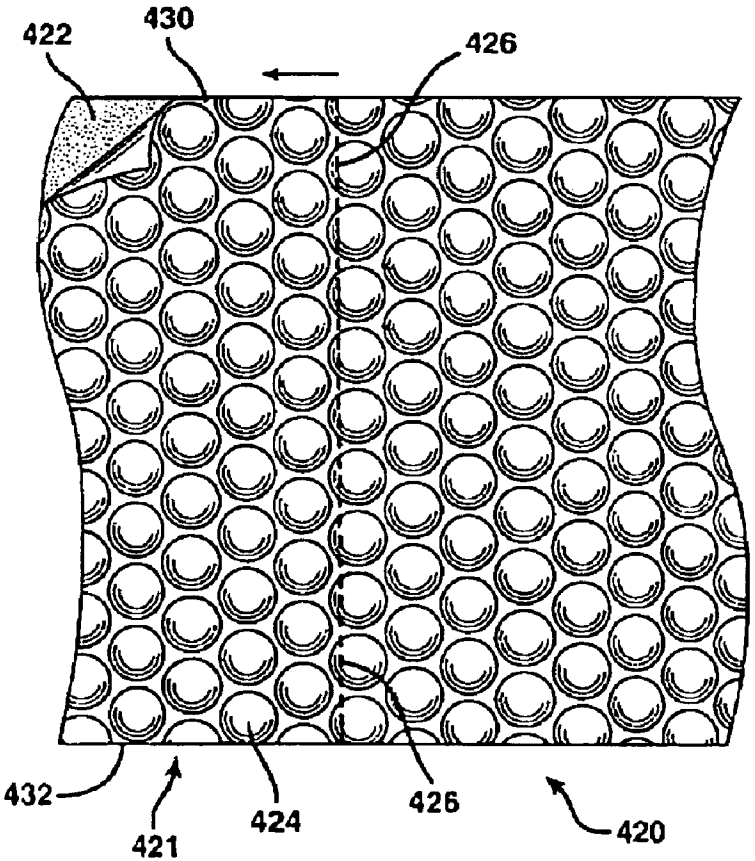
FIG. 16 is a planar view of a metallic insulating laminate in accordance with an alternative embodiment of the present invention.

In an alternative embodiment, instead of a bag with side wall gussets, a bag in accordance with the invention can be made which has sides that are simply folds in the metallic insulating laminate, or else seals created when a first sheet of the laminate is brought in congruent relationship with a second sheet of the laminate. In this alternative embodiment, to achieve a bag with stand-up functionality, a gusset can be installed in the bottom of the bag. This can be done by the same technology used to make side gussets. For example, referring to FIGS. 16 to 18, the metallic insulating laminate can be cut or separated along a perforated line, but in this embodiment the perforated pattern is a straight line having no extended section 328. The laminate is then longitudinally folded (see FIG. 17), and then a wheel or other mechanical device can be used to tuck one end of the folded laminate to create a gusseted bottom member. Thus, with reference to FIGS. 16 to 18, a metal foil or metallized foil 422 is adhered by any conventional means, such as an appropriate adhesive, to a thermal insulating material 424 such as BUBBLE WRAP® air cushioning material sold by Sealed Air Corporation. A perforated pattern 426 is made in the laminate in periodic fashion, one such pattern being shown in FIG. 16. The laminate 420 can be periodically pulled in the direction of the arrow to separate a section 421 of the laminate from the remainder of the laminate, along the perforations of perforated pattern 426. Alternatively, the laminate can simply be die cut, or otherwise cut or separated from the remainder of the laminate stock. FIG. 17 is a planar view of the section 421 of the metallic insulating laminate of FIG. 16 after it has been cut, pulled, or otherwise separated from the remainder of the laminate stock 420. Longitudinal edges 430 and 432 of the portion of the laminate are folded a desired distance toward each other (i.e. toward the longitudinal centerline of the laminate), and longitudinally sealed by heat sealing, adhesive, gluing, etc. in a fin or lap seal arrangement to produce a longitudinal seal 434. FIG. 18 is a planar view of the portion 421 of the metallic insulating laminate of FIG. 12 after it has been sealed together along its bottom edge to create bottom transverse seal 437, and then gusseted along its thus sealed bottom edge. A bottom gusset is indicated at 442, this bottom gusset accommodating the bottom transverse seal 437.

In still another alternative embodiment, a bag can be made like that of FIGS. 11 to 13, with side gussets, but in which the perforated pattern is a straight line having no extended section 328.

Figure 14:
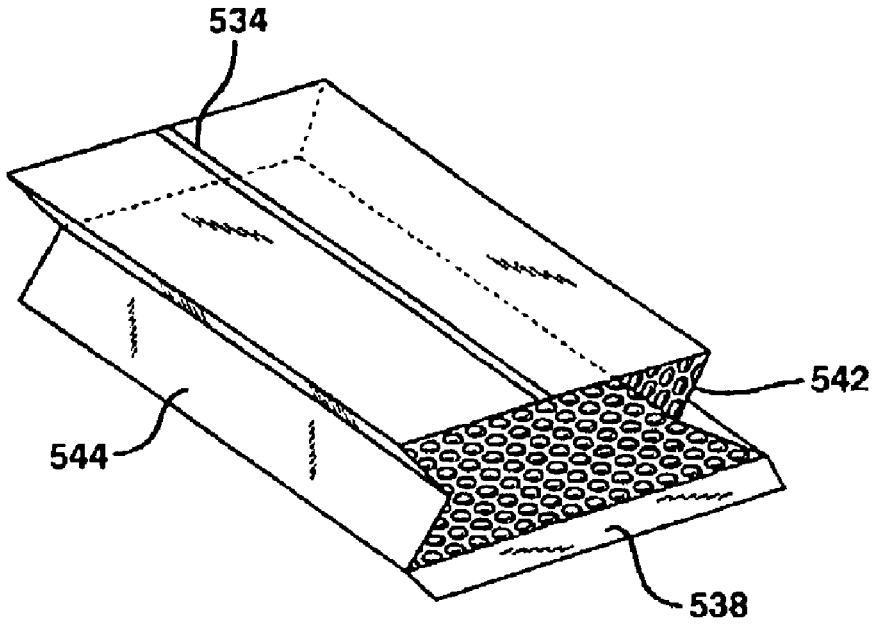
FIG. 14 is a perspective view of a folded and longitudinally sealed metallic insulating laminate similar to that of FIG. 12, in an open position.

FIG. 14 is a perspective view of a folded and longitudinally sealed metallic insulating laminate similar to that of FIG. 12, in an open position before the bottom member has been formed in accordance with any of the embodiments disclosed herein. Side wall gussets 542 and 544 correspond to side wall gussets 342 and 344 of FIG. 13. Longitudinal seal 534 corresponds to longitudinal seal 334 of FIG. 13. Unfolded section 538 corresponds to unfolded section 338 of FIG. 13.

Figure 15:
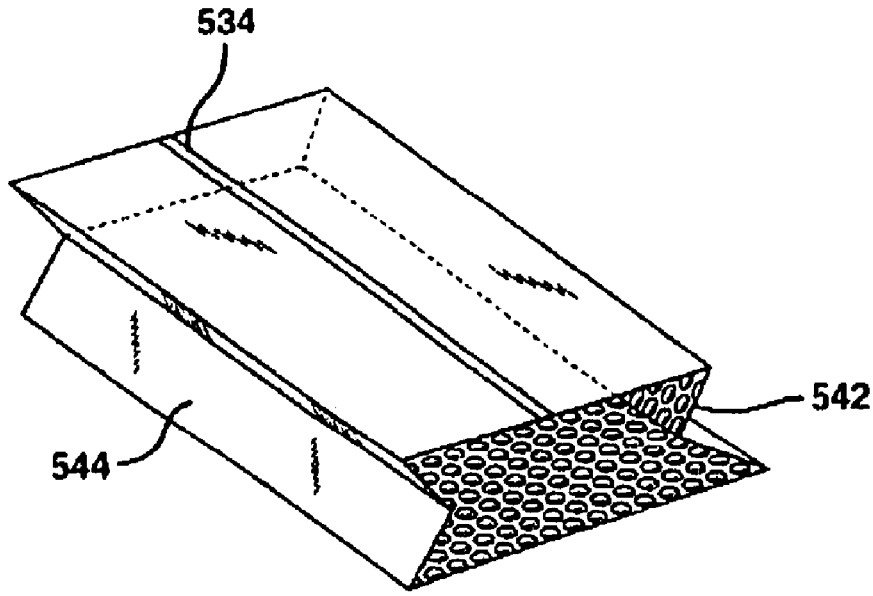
FIG. 15 is a perspective view of another folded and longitudinally sealed metallic insulating laminate similar to that of FIG. 12, in an open position.

FIG. 15 is a perspective view of another folded and longitudinally sealed metallic insulating laminate similar to that of FIG. 14, in an open position, but in which no unfolded section 538 is present. In this embodiment, the laminate can be brought together at the bottom portion and glued or sealed together, or folded over and then sealed to the wall of the bag.

In still another alternative embodiment, a bag can be made using the metallic insulating laminate as described herein, by longitudinally folding the laminate on itself to create a centerfolded laminate (the longitudinal centerline of the metallic insulating laminate preferably defining the longitudinal fold of the centerfolded laminate); forming a gusset in the longitudinal fold; making a first and second transverse seal in the gusseted, centerfolded laminate; and making a first and second transverse cut in the gusseted, centerfolded laminate (preferably concurrent with or proximate the first and second transverse seals) to produce a bag with a bottom gusset. This alternative generally follows conventional processes for making some stand-up pouches currently available e.g. in the pet food area.

For each of these methods, the top of the bag, including closure flaps if present, can be made by the same methods described herein with respect to the bottom of the bag, choosing suitable perforation patterns at appropriate spacing in the metallic insulating laminate. An extended section 328 can be used, and modified in shape and size for both the bottom and top portions of the bag. Although the extended flap 328 is shown in FIGS. 11 and 12 as a metallic insulating laminate including a thermal insulating material, alternatively the extended flap can comprise a metal foil or metallic coated web without the thermal insulating layer, e.g. to facilitate adhesion or sealing of this flap to a wall of the bag. Closure flaps, if present, and supplemental flap 176 and similar features can be alternatively separately die cut or otherwise made from various materials as appropriate, including polymeric materials, and adhered by heat sealing or other suitable means to the front wall of the bag. This step can be done at any suitable time in the manufacture process.

Those skilled in the art will understand that modifications in the invention can be made without departing from the scope of the invention as claimed in the claims that follow.

What is claimed is:

1. A metallic laminated gusseted insulated bag comprising:

a) a front wall having two lateral edges, a top edge, and a bottom edge;

b) a rear wall having two lateral edges, a top edge, and a bottom edge;

c) a first gusseted side wall having two lateral edges, a top edge, and a bottom edge;

d) a second gusseted side wall having two lateral edges, a top edge, and a bottom edge;

e) a bottom member; and f) a means for hermetically closing the bag;

wherein:

i) the front and rear walls are joined along their respective lateral edges to the respective lateral edges of the first and second gusseted side walls;

ii) the front and rear walls are joined along their respective bottom edges to the bottom member; and iii) the first and second gusseted side walls are joined along their respective bottom edges to the bottom member;

the front and rear walls, and the first and second gusseted side walls, each comprising a) an outer ply comprising a metallic foil or metallic coated web, and b) an inner ply having a first surface and a second surface, the inner ply comprising a thermal insulating layer;

the metallic foil or metallic coated web being adhered to the first surface of the inner ply; and wherein the means for hermetically closing the bag comprises a closure flap, attached to the top edge of the rear wall, the closure flap having a first and second lateral flap extension, the flap adapted to fold down over the top edges of the front and rear wall along a fold line defined by the top edge of the rear wall, and the first and second lateral flap extensions adapted to fold inwardly across a portion of the rear wall of the bag, after the flap has been folded down.

2. The bag of claim 1 wherein the closure flap is integrally attached to the top edge of the rear wall.

3. The bag of claim 1 wherein the closure flap comprises an adhesive layer disposed on one side of the flap.

4. The bag of claim 1 wherein the adhesive layer is covered by a release tape.

5. The bag of claim 1 wherein the thermal insulating layer comprises an air cellular material.

6. The bag of claim 1 wherein the front and rear walls are joined along their respective lateral edges to the first and second gusseted side walls by means of a fold.

7. The bag of claim 1 wherein the front and rear walls are joined along their respective bottom edges to the bottom member by means of a fold.

8. The bag of claim 1 wherein the first and second gusseted side walls are joined along their respective bottom edges to the bottom member by means of a fold.

9. The bag of claim 1 wherein the front wall and rear wall, and the first and second gusseted side walls, are of substantially equal length.

* * * * *